US005287739A

United States Patent [19]

Kingsbury

[11] Patent Number: 5,287,739

[45] Date of Patent: Feb. 22, 1994

[54] MOUNTING BRACKET FOR RAILWAY CAR COUPLER

[75] Inventor: Ronald L. Kingsbury, Roanoke, Va.

[73] Assignee: Norfolk Southern Railway Co., Norfolk, Va.

[21] Appl. No.: 937,677

[22] Filed: Sep. 1, 1992

[51] Int. Cl.[5] ..... G01L 5/28

[52] U.S. Cl. ..... 73/129; 248/53

[58] Field of Search ..... 73/129; 213/1 R, 75 R, 213/76, 77; 248/53, 229, 534

[56] References Cited

U.S. PATENT DOCUMENTS

| | | | |
|---|---|---|---|
| 581,890 | 5/1897 | Thomas | 248/53 X |
| 4,592,217 | 6/1986 | Fernandez | 73/129 |
| 4,665,858 | 5/1987 | Harrigal | 116/30 |
| 4,691,563 | 9/1987 | Martin | 73/129 |
| 4,747,302 | 5/1988 | Goss | 73/129 |
| 4,876,885 | 10/1989 | Martin et al. | 73/129 |
| 5,131,269 | 7/1992 | Blosnick | 73/129 |

*Primary Examiner*—Jerry W. Myracle

*Attorney, Agent, or Firm*—Watson, Cole, Grindle & Watson

[57] ABSTRACT

A mounting bracket for securing telemetry and other equipment on the railway car coupler of the end train includes a split strap secured about the rectangular coupler shrank and tightened by a screw bolt. The bracket has one or more stabilizing flanges in bearing engagement with surfaces of the coupler knuckle, and the equipment is mounted to one of such flanges.

8 Claims, 2 Drawing Sheets

MOUNTING BRACKET FOR RAILWAY CAR COUPLER

BACKGROUND OF THE INVENTION

This invention relates generally to a bracket for mounting equipment on a railway car coupler, and more particularly to a coupler mount for securing equipment to the shaft of the coupler of the end car in a train.

As is known cabooseless freight trains require equipment known as an end of train device (EOTD) capable of sensing and monitoring the brake line pressure and which is capable of confirming the presence of the end car.

The EOTD typically provides an output signal proportional to the air pressure within the brake pipe, repetitively monitors this output signal to measure the value of brake pipe air pressure, stores the brake pipe air pressure value, and repetitively transmits a report including the brake pipe air pressure value that is currently stored. A remote display unit mounted in the lead locomotive of the train receives each report from the EOTD, extracts the brake pipe air pressure value in each report, and displays the brake pipe air pressure value.

The EOTD is typically mounted on last car of the train at some suitable location, such as on the end coupler of the last car.

The EOTD is oftentimes mounted on the knuckle of the end coupler with the use of clamping jaws engaging relief holes at the side of the coupler, such relief holes being provided during the casting of the coupler for lightening purposes. Otherwise, the telemetry equipment may be mounted using a banana shaped member extending through a pair of such relief holes. The equipment may otherwise be clamped into the coupler flaghole.

Such prior mounting devices are however cumbersome and are otherwise unsuitable for quickly and repeatedly mounting the equipment to the car coupler and removing the equipment therefrom.

Moreover, the equipment to be mounted on the end coupler may include not only an EOTD but also a brake pipe continuity valve interconnected with the EOTD of the type set forth my prior U.S. application Ser. No. 850,021, filed Mar. 12, 1992, now U.S. Pat. No. 5,180,213, and commonly owned herewith. Such a valve and the EOTD must therefore be securely mounted in place without shifting or loosening as when exposed to vibration and shock during car movement.

SUMMARY OF THE INVENTION

It is therefore an object of the present invention to provide a mounting bracket for a railway car coupler which avoids the disadvantages of the known clamps and mounting brackets, is of simple and economical construction yet highly reliable in securely and quickly mounting the equipment on the car coupler.

The bracket according to the invention engages the coupler shaft of the standard type E or type F car coupler having a shaft of substantially rectangular cross-section. The bracket surrounds the shaft and is securely and quickly tightened in place.

The bracket forms a clamp which embraces the coupler shaft, the clamp having an arcuate flange adapted to engage a side surface of the car coupler having a complementary arcuate shape for thereby stabilizing the clamp when in place about the coupler shaft. The flange has a support surface on which the equipment can be mounted.

The clamp may have additional flanges adapted to engage horizontal and/or vertical surfaces of the coupler knuckle for further stabilizing the bracket when mounted in place.

The bracket may be in the form of a split rigid strap surrounding the shaft and tightened in place using a bolt tightener.

The strap, formed of upper and lower clamp arms, may have anti-slip means such as in the form of a weldment or the like on the undersurface of one or both arms for avoiding any slippage of the clamp toward the car body.

Other objects, advantages and novel features of the invention will become more apparent from the following detailed description of the invention when taken in conjuction with the accompanying drawings.

DETAILED DESCRIPTION OF THE INVENTION

Figure 1:
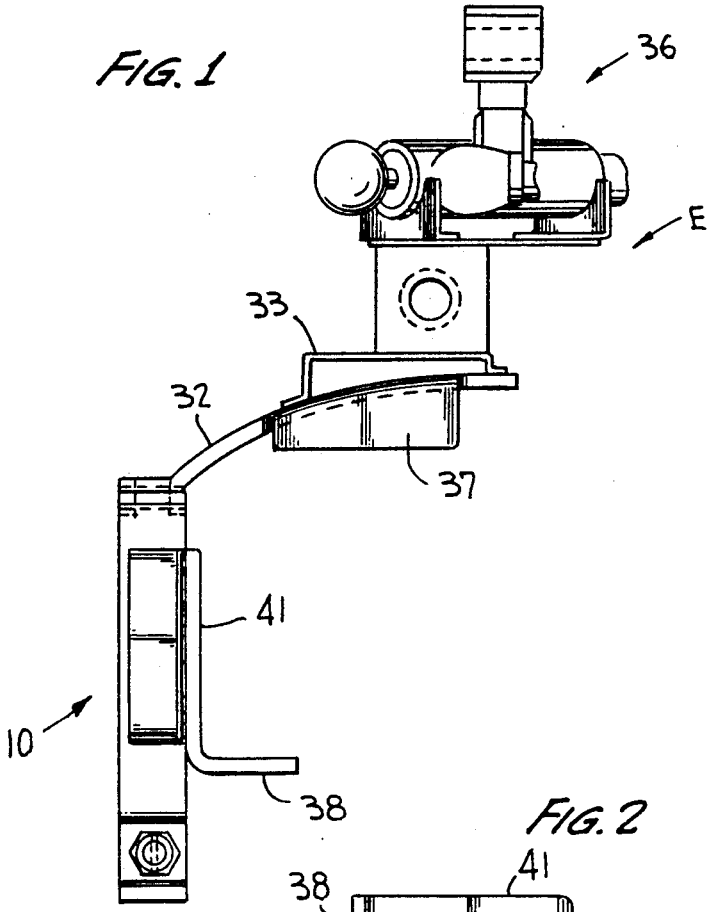
FIG. 1 is a top plan view of the mounting bracket according to the invention showing the equipment to be mounted supported on to the bracket.
Figure 2:
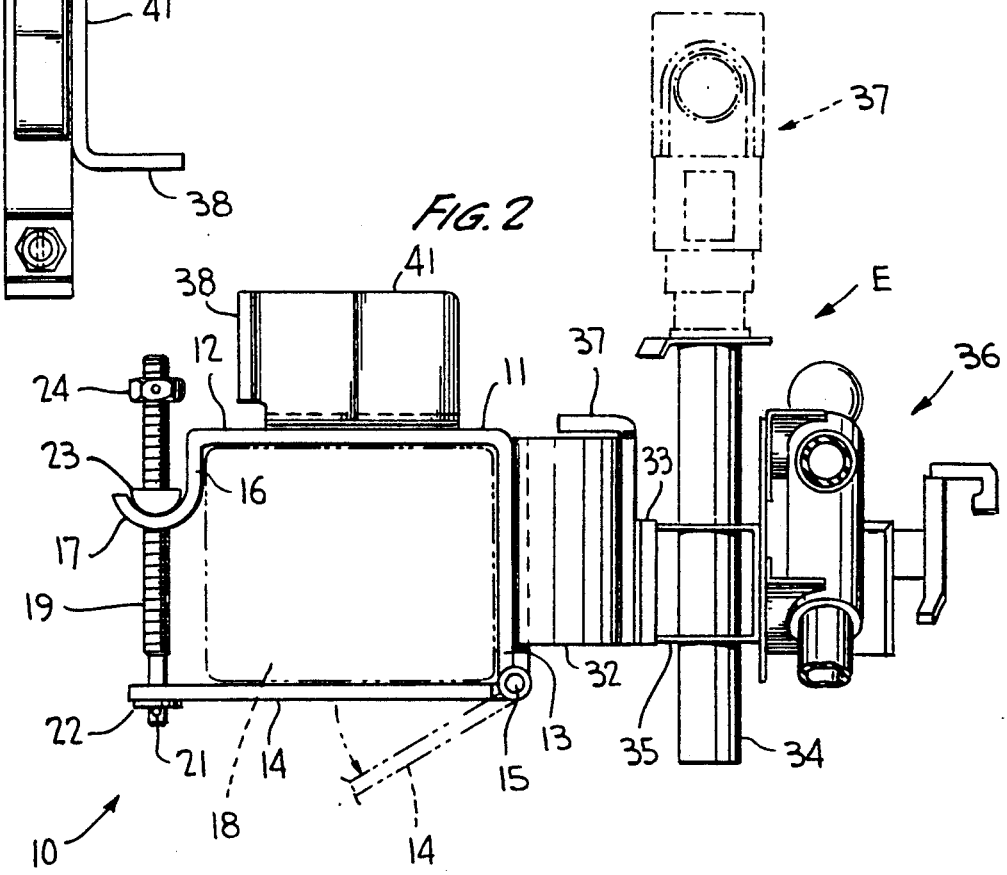
FIG. 2 is a front elevational view of the bracket and equipment of FIG. 1.
Figure 3:
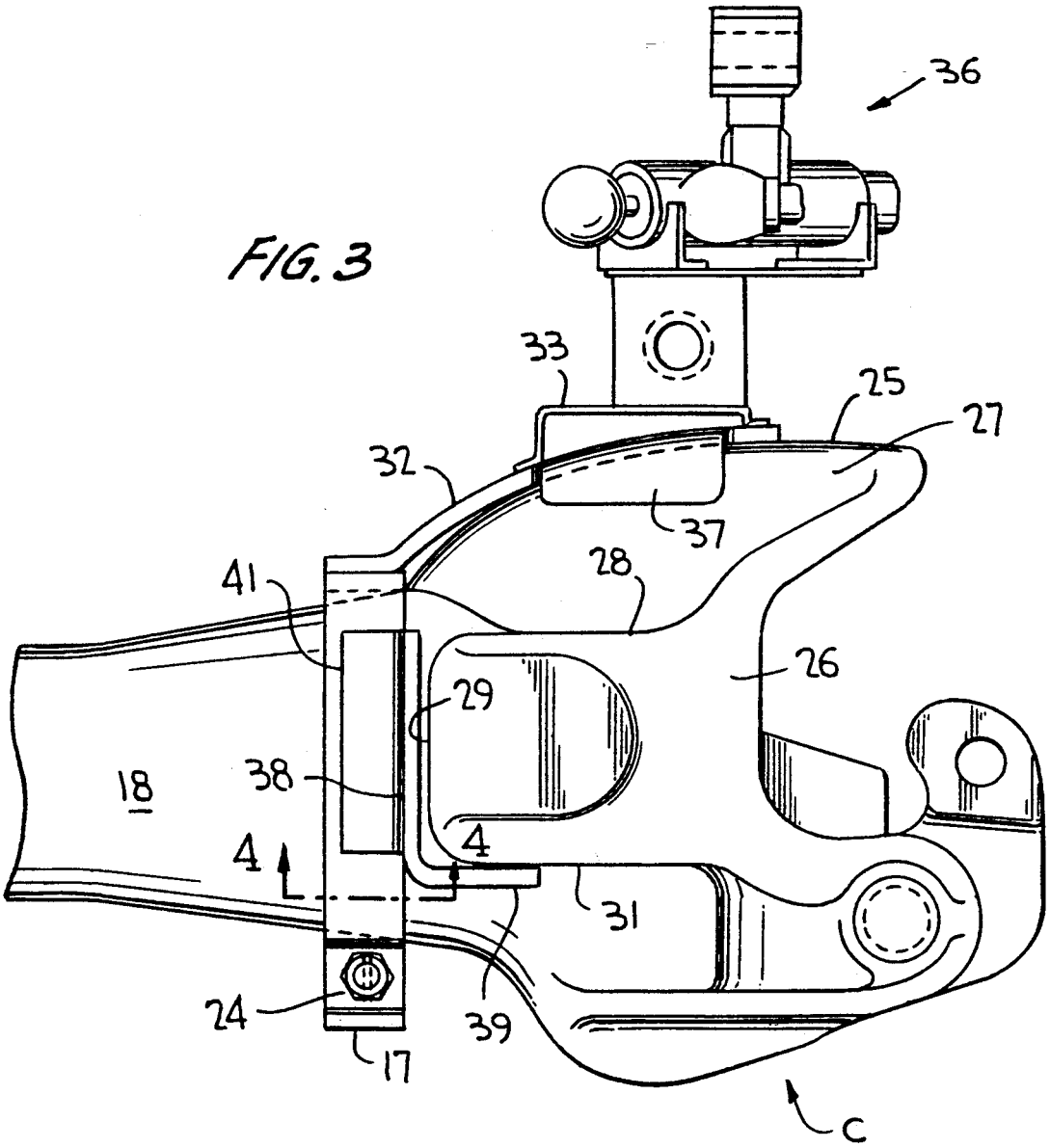
FIG. 3 is a top plan view of the bracket and equipment of FIG. 1 shown mounted on a typical railway car coupler.

Turning now to the drawings wherein like reference characters refer to like and corresponding parts throughout the several views, a mounting bracket generally designated 10 is shown in FIGS. 1 to 3 to which equipment generally designated E is secured for mounting the equipment on a standard car coupler C shown in FIG. 3.

The bracket may be in the form of a split rigid clamp or strap having a substantially L-shaped member 11 of rugged steel with an upper arm 12 and a side arm 13 to which a lower arm 14 is hinged as 15.

The upper arm may have a reverse bend forming perpendicularly related flanges 16 and 17, flange 16 lying parallel to arm 13, and flange 17 lying parallel to arm 14.

The bracket is of rectangular section adapted to embrace the shaft or arm 18 of the coupler, which shaft is likewise of rectangular cross-section.

A thread bolt 19 is provided for tightening the bracket in place about the coupler shaft, the bolt extending through suitable openings in flange 17 and at the end of arm 14. The bolt has a pin 21 near its free end supporting a washer 22 underlying arm 14. A lock nut 23 or the like bearing against flange 17, when threaded, tightens the bracket about coupler shank 18 shown in phantom outline in FIG. 2. It should be noted that the reverse bend in arm 12 forming flange 16 permits a side engagement with the coupler shank by a portion of the upper arm. Otherwise, however, the upper arm can be straight without a reverse bend, without departing from the spirit of the invention.

And, a nut 24 pinned to bolt 19 as at 20 can be provided to facilitate tightening of arms 12 and 14 while immobilizing nut 23.

Car coupler C is a standard E or F type coupler having an arcuate side 25 and an essentially raised central portion 26 extending above a flat horizontal surface 27. The central raised portion presents flat vertical surfaces 28, 29, 31. The knuckle of the car coupler is otherwise formed as shown in FIG. 3.

The bracket has an arcuate flange 32 extending from side arm 13, the flange being substantially complementary in shape to that of arcuate side 25 of the knuckle.

A support plate 33 is welded or otherwise fixed to the outer surface of flange 32 to which a staff 34 is affixed as by brackets 35. A brake pipe continuity valve system 36, provided as for the purpose and in the manner set forth in my copending U.S. application Ser. No. 850,021, may be mounted to the staff via brackets 35. And, and end-of-train device 37 can be conveniently mounted on the staff as most clearly shown in FIG. 2.

The flat arms 12, 13, 14 of the bracket snugly embrace corresponding sides of the rectangular coupler shank to avoid shifting of the bracket about the longitudinal axis of the coupler. Likewise, arcuate flange 32 adds to the stability of the mount as the load of the equipment E supported on flange 32 bears against knuckle side 25.

For added stability, a horizontal flange 37 may be provided on flange 32 in contact engagement with upper surface 27 of the knuckle. And, vertically extending flanges 38 and 39 of an L-shaped member 41, welded or otherwise fixed to upper arm 12 of the bracket, respectively bear against vertical surfaces 29 and 31 of central raised portion 26 of the knuckle.

When the bracket is assembled in place, any turning or shifting movement thereof either along or about the longitudinal axis of the coupler is avoided. Thus, the equipment which may be in the form of an EOTD and a brake pipe continuity valve are securely supported without the likelihood of dislodgement during train movement and operation.

Figure 4:
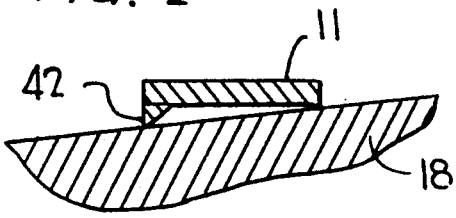
FIG. 4 is a sectional view taken substantially along the line 4—4 of FIG. 3.

Since the coupler shaft typically slopes on all four sides in a direction away from the knuckle, such that the shaft cross-section is greater at the location of bracket 10 compared to a location spaced inwardly of the knuckle, the undersurface of one or more of the arms 12, 13, 14 of the bracket may be provided with anti-slip means which may be in the form of a weldment 42 or the like shown in FIG. 4. By such means the bracket arm or arms frictionally engage the coupler shaft surface to avoid any possible shifting of the bracket in a direction away from the knuckle.

From the foregoing it can be seen that a bracket mount for a railway car coupler has been devised which is of extremely simple construction yet is highly effective in securely mounting telemetry and other equipment in place on the car coupler and is capable of both quick connect and disconnect operations when necessary. Hinged arm 14 permits the bracket and the equipment affixed thereto to be simply mounted in place as bracket arms 12 and 13 are lowered over the coupler shaft with arm 14 opened to its phantom outline position of FIG. 2. Thereafter, arm 14 is simply swung to be seated over washer 22 after which the thread bolt is tightened for securing the bracket in place.

Obviously, many modifications and variations of the present invention are made possible in the light of the above teachings. It is therefore to be understood that within the scope of the appended claims the invention may be practiced otherwise than as specifically described.

What is claimed is:

1. A bracket for mounting equipment to a coupler shaft of substantially rectangular cross-section of a railway car coupler comprising, split strap means adapted to embrace the coupler shaft, means for tightening said strap means in place about the shaft, said strap means having a first flange of arcuate shape adapted to engage a side surface of the car coupler of substantially complementary arcuate shape for stabilizing said strap means when in place about the coupler shaft, said flange having a support surface on which the equipment can be affixed.

2. The bracket according to claim 1, wherein said strap means has a second flange on said first flange adapted to engage an upper horizontal surface of the coupler.

3. The bracket according to claim 1, wherein said strap means has a third flange adapted to engage at least one upper vertical surface of the coupler.

4. The bracket according to claim 3, wherein said third flange is substantially L-shaped adapted to engage perpendicularly related upper vertical surfaces of the coupler.

5. The bracket according to claim 1, wherein said strap means include upper and lower arms for engaging upper and lower surfaces of the coupler shaft, an undersurface of one of said arms having anti-slip means thereon for enhancing engagement with one of said shaft surfaces.

6. The bracket according to claim 1, wherein said strap means comprises a substantially L-shaped member including an upper arm, and a lower arm hinged to said member, said tightening means extending between said upper and lower arms.

7. The bracket according to claim 6, wherein said member includes a side arm to which said first flange is mounted.

8. The bracket according to claim 6, wherein an undersurface of one of said arms has anti-slip means thereon to avoid any slippage between said strap means and the coupler shaft.

* * * * *